US010682034B2

(12) United States Patent
Ribbe et al.

(10) Patent No.: US 10,682,034 B2
(45) Date of Patent: Jun. 16, 2020

(54) CLEANING DEVICE HAVING FLUID RESERVOIR HANDLE WITH INTEGRAL REFILL/RESERVOIR RECEIVER

(71) Applicant: Geerpres, Inc., Muskegon, MI (US)

(72) Inventors: Scott E. Ribbe, West Olive, MI (US); Erin L. Olesen, Saugatuck, MI (US)

(73) Assignee: Geerpres, Inc., Muskegon, MI (US)

( * ) Notice: Subject to any disclaimer, the term of this patent is extended or adjusted under 35 U.S.C. 154(b) by 129 days.

(21) Appl. No.: 15/649,154

(22) Filed: Jul. 13, 2017

(65) Prior Publication Data

US 2019/0014967 A1 Jan. 17, 2019

(51) Int. Cl.

| | |
|---|---|
| ***A47K 13/22*** | (2006.01) |
| ***A46B 11/00*** | (2006.01) |
| ***A47L 13/22*** | (2006.01) |

(52) U.S. Cl.

CPC ..... *A47L 13/22* (2013.01); *A46B 11/0013* (2013.01)

(58) Field of Classification Search

CPC ..... A47L 13/20; A47L 13/22; A47L 13/26; A46B 11/0013

See application file for complete search history.

(56) References Cited

U.S. PATENT DOCUMENTS

| | | | | |
|---|---|---|---|---|
| 371,899 | A | 10/1887 | Osborne | |
| 875,422 | A | 12/1907 | Garvey | |
| 894,359 | A | 7/1908 | Anthony | |
| 2,069,673 | A | 2/1937 | Lima | |
| 2,304,257 | A | 12/1942 | Jilbert | |
| 2,578,078 | A | 12/1951 | McNair et al. | |
| 2,609,557 | A | 9/1952 | Reed | |
| 2,893,607 | A | 7/1959 | Vosbikian et al. | |
| 3,080,590 | A | 3/1963 | Mullinix et al. | |
| 3,134,129 | A | 5/1964 | Allen | |
| 5,469,991 | A | 11/1995 | Hämäläinen | |
| 5,735,620 | A | 4/1998 | Ford | |
| 5,933,913 | A | 8/1999 | Wright et al. | |
| 6,003,786 | A | 12/1999 | Schwary | |
| 6,227,744 | B1 | 5/2001 | Fodrocy et al. | |
| 6,269,837 | B1 | 8/2001 | Arent et al. | |
| 6,467,983 | B2 | 10/2002 | Fodrocy et al. | |
| 6,981,533 | B2 * | 1/2006 | Zorzo | A47L 13/22 141/18 |
| 7,172,099 | B2 * | 2/2007 | Hofte | A47L 13/22 222/481.5 |

(Continued)

FOREIGN PATENT DOCUMENTS

| | | |
|---|---|---|
| DE | 1104662 | 4/1961 |

*Primary Examiner* — Nicholas J. Weiss

(74) *Attorney, Agent, or Firm* — Mitchell Intellectual Property Law, PLLC

(57) ABSTRACT

A mop or like cleaning implement with a fluid reservoir and dispensing handle and with an integral refill/add-on reservoir receiver which embraces the handle. A refill/add on reservoir fluid container is inserted into the receiver to supplement and/or replenish the volume of liquid contained in the fluid reservoir handle. The refill fluid container can be removed and replaced when empty. The reservoir and dispensing handle can be filled and refilled independently of the refill fluid container, or can be refilled using the refill container. Either way, a refill container can be inserted into the refill receiver to supplement the volume of fluid in the reservoir handle.

18 Claims, 11 Drawing Sheets

(56) References Cited

U.S. PATENT DOCUMENTS

| | | | | |
|---|---|---|---|---|
| 9,687,133 | B2 * | 6/2017 | Zhu | A47L 13/22 |
| 9,788,702 | B1 * | 10/2017 | Zhu | A47L 13/22 |
| 2006/0269353 | A1 | 11/2006 | Tanaka et al. | |
| 2012/0269567 | A1 | 10/2012 | Crawford et al. | |
| 2016/0058262 | A1 | 3/2016 | Charlton | |
| 2018/0213996 | A1 * | 8/2018 | Sacks | A47L 13/22 |

* cited by examiner

CLEANING DEVICE HAVING FLUID RESERVOIR HANDLE WITH INTEGRAL REFILL/RESERVOIR RECEIVER

BACKGROUND OF THE INVENTION

The present invention relates to cleaning implements with gravity feed liquid dispensers. Liquid dispensers associated with cleaning implements, including mops, squeegees and brooms, are well known in the art of applying cleaning liquids, germicides and waxes to floor surfaces. Dispensers are provided as a container appended externally to the cleaning implement. For example, a liquid container may be mounted with brackets onto a mop handle. With the dispenser mounted to the mop handle, an operator may apply liquids onto a surface on which the operator is conducting cleaning tasks without re-saturating the mop by dipping the mop into a bucket or container filled with a cleaning liquid. Accordingly, the operator may conduct the cleaning task uninterrupted by frequent re-saturations, and without having to transport a bucket filled with cleaning liquids.

Typically, liquid is dispensed from handle mounted containers by the force of gravity. In U.S. Pat. No. 5,469,991 to Hamalainen, a bulky airtight liquid holding container is connected externally to a mop handle. Liquid flows out from the appended container through a system of tubes onto a surface by its own weight. The principle of operation of the dispenser is such that when air is allowed to enter the appended external container, a corresponding amount of liquid held in the appended container is dispensed onto the surface by force of gravity.

U.S. Pat. Nos. 6,467,983 and 6,227,744 disclose bucketless mops having fluid retaining and dispensing handles. An upper dispensing valve is mounted in the top of the tubular handle of the mop can be removed to facilitate filling the handle with cleaning fluid. Alternatively, the handle may include a separate filling opening, not shown in the drawings.

SUMMARY OF THE INVENTION

The present invention comprises a mop or like cleaning implement with a fluid reservoir handle, and with an integral refill/acid-on reservoir receiver. A refill/add-on reservoir fluid container can be removably inserted into the refill receiver to supplement and/or replenish the volume of liquid contained in the fluid reservoir handle.

DETAILED DESCRIPTION OF TILE PREFERRED EMBODIMENT

Introduction

Figure 1:
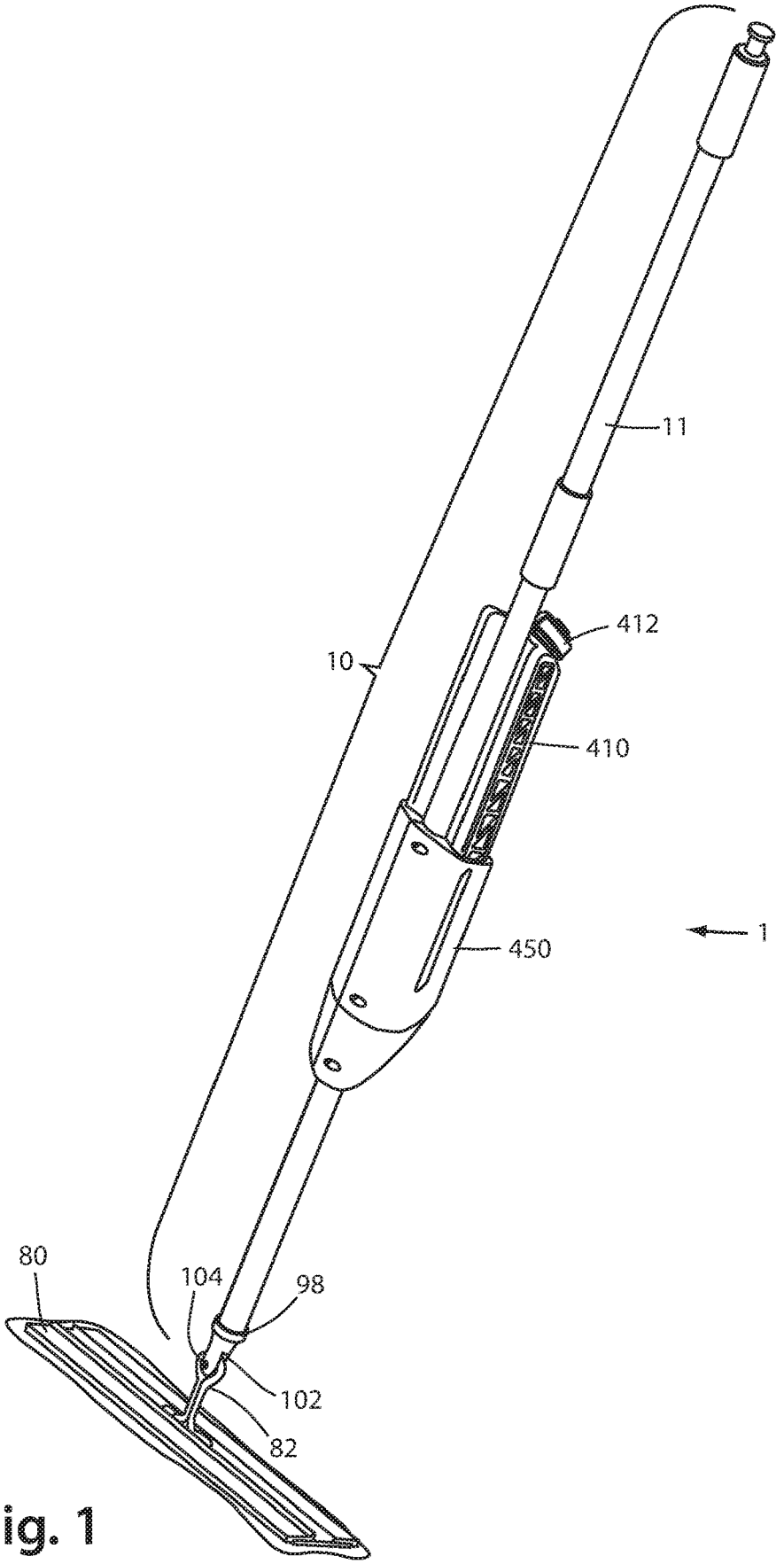
FIG. 1 is a perspective view of the preferred embodiment cleaning implement.

In the preferred embodiment, the present invention comprises a refill/add-on reservoir receiver and dispensing system 400 integrated into a cleaning implement 1 with a fluid reservoir handle 10. (FIGS. 1 and 7) Refill receiver and dispensing system 400 comprises a refill/add-on reservoir container 410 (sometimes referred to as a "refill container") and a receiver 450 integrally mounted on said reservoir handle 10 for receiving said refill container 410 and dispensing the fluid contained therein into said reservoir handle 10.

Preferred Cleaning Implement 1

Any cleaning implement which includes a reservoir handle can be employed in the present invention. In the preferred embodiment, the cleaning implement 1 is of the type shown and described in U.S. Pat. Nos. 6,467,983 and 6,227,744. The description of cleaning implement 1 from those patents is substantially repeated herein.

FIG. 1 depicts the reservoir and dispensing handle as it would be configured while conducting a cleaning task (sometimes referred to simply as a "dispensing handle). Dispensing handle 10 is coupled to a flat mop head 80. Liquid is dispensed directly from the dispensing outlet 98 as depicted.

Figure 2:
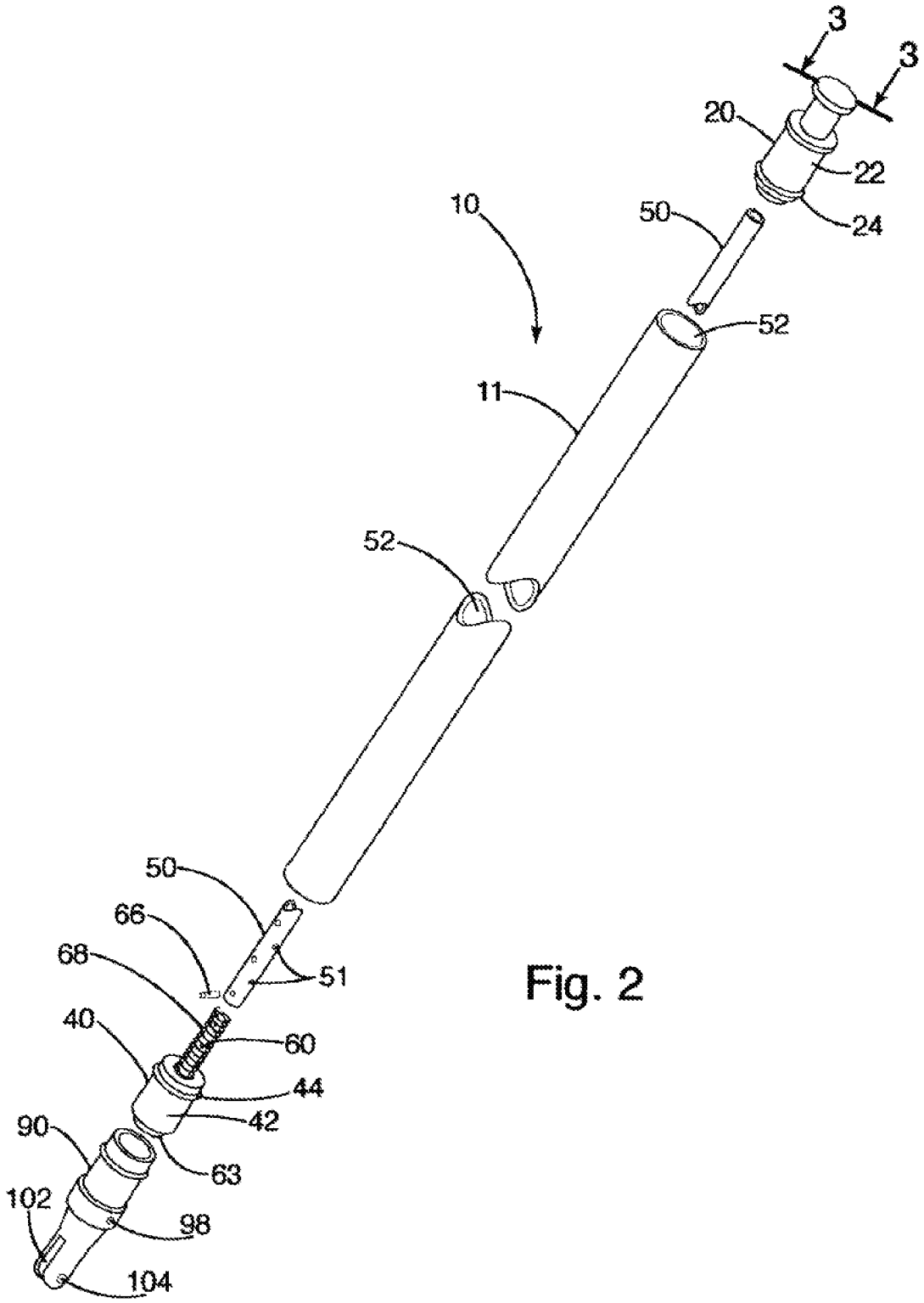
FIG. 2 is an exploded view of the internal components of the apparatus.

With reference to FIG. 2, the internal components of the reservoir and dispensing handle generally include an upper valve assembly 20, a push rod 50, a lower valve assembly 40, and an end connector 90. Preferably, all components are made from non-corrosive, rigid materials such as plastic, stainless steel or an anodized aluminum alloy, or any combination thereof.

Figure 3:
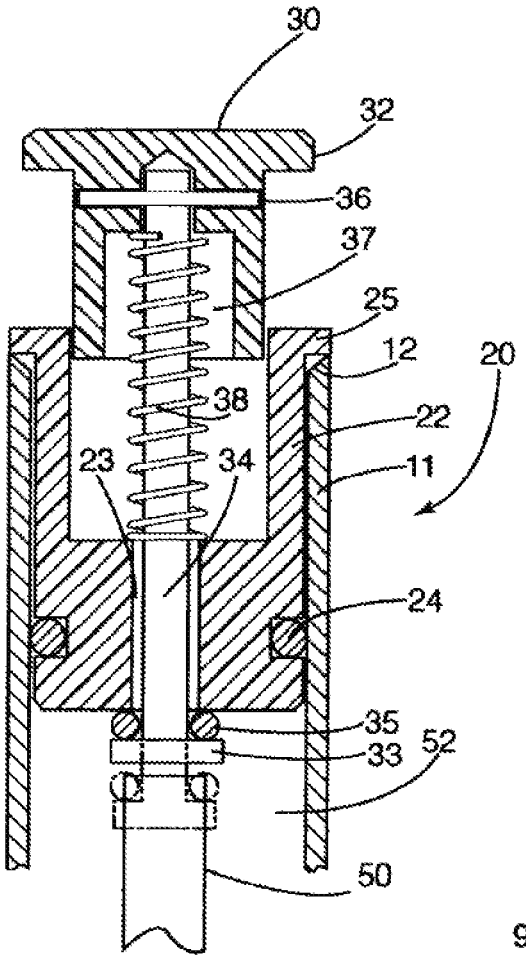
FIG. 3 is a sectional view of the apparatus taken along line 3-3 of FIG. 2.

As can be seen in FIGS. 2 and 3, the upper valve assembly 20 includes a cylindrical upper valve body 22 that fits closely into a tubular reservoir portion 11 of handle 10. This upper valve body is preferably manually removable from the tubular reservoir portion 11 to facilitate filling of chamber 52 with liquid, and cleaning of the valve assemblies, but may also be fixedly attached the tubular reservoir portion 11, if alternative filling orifices (not shown) are provided in the tubular reservoir portion to allow liquid to be injected into chamber 52. Chamber 52 is merely the interior of reservoir portion 11, and hence reference to "filling chamber 52," or "filling reservoir portion 11" are simply alternative ways to refer to the same thing. Similarly, speaking of the level of liquid in reservoir portion 11 or chamber 52 means the same thing.

O-ring 24 creates an air tight seal between the upper valve body 22 and the tubular reservoir portion 11. Lip 25 abuts and seats against an edge 12 of the tubular reservoir portion at the upper portion of the tubular reservoir portion 11. Edge 12 is preferably beveled to facilitate filling of the tubular reservoir portion 11 with liquid. The upper valve body 22 includes an internal bore in which a push button assembly 30 is longitudinally disposed.

The push button assembly 30 includes push button 32 and valve stem 34, connectively attached to push button 32 with pin 36. Alternatively, the push button 32 and valve stem 34 may be connected by adhesives, screws or other fasteners, or formed from a single piece. Push button 32 also may be solid rather than as depicted including an internal longitudinal bore 37. Bias element 38, preferably a coil spring, encircles valve stem 34 and provides bias between the upper valve body 22 and the push button 32 within the internal longitudinal bore 37. The bias element may be a helical or leaf spring, elastomer, or any other material suitable for biasing push button 32 relative to the upper valve body 22 while resisting corrosion due to liquids used in the dispensing handle 10.

Upper valve stem 34 fits through upper valve body passageway 23, and extends below the upper valve body 22. At the lower most portion of the upper valve stem 34 is lip 33. O-ring 35 is disposed on, or at least near, lip 33. In storage mode (shown in solid lines), O-ring 35 seats tightly between lip 33 and the lower portion of the upper valve body 22 so that fluids (liquid or air) cannot pass through passageway 23. In dispensing mode (shown in broken lines) upper valve stem 34 is displaced downward to break the seal between lip 33 and the lower portion of upper valve body 22. In an alternative embodiment, the lower portion of the upper valve body 22 may be beveled (not shown) to facilitate seating of the O-ring 35 against the upper valve body 22. Notably, any sealing mechanism may be used in place of O-ring 35 to create an airtight seal between the lower portion of the upper valve body 22 and lip 33.

Figure 4:
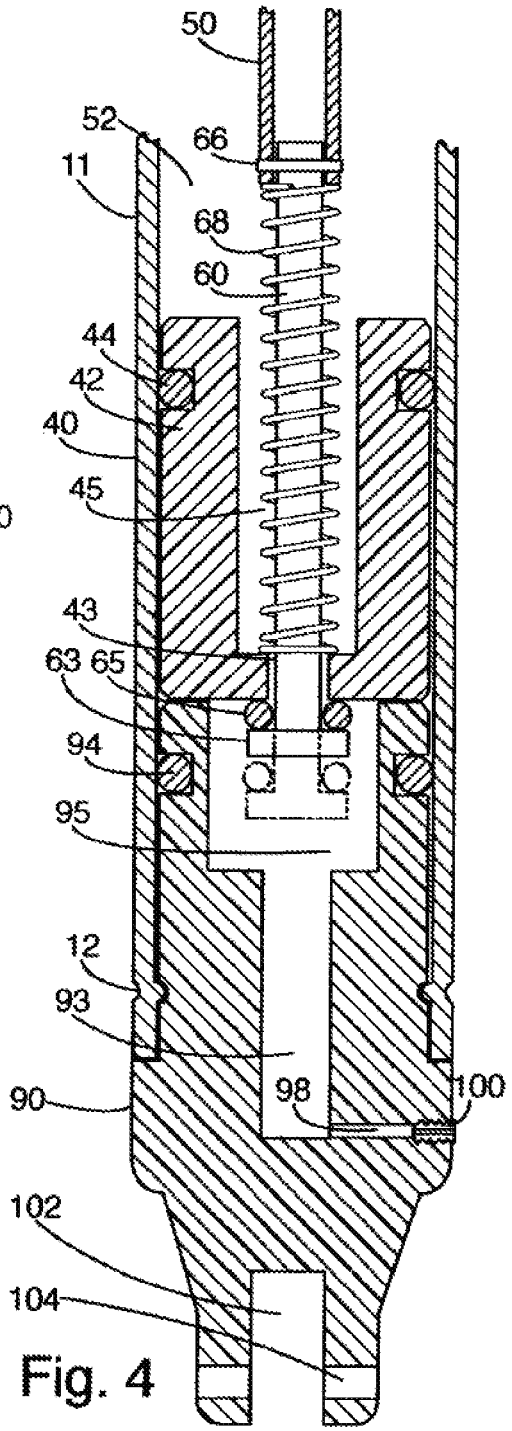
FIG. 4 is a sectional view of the apparatus taken along line 3-3 of FIG. 2.

As illustrated in FIGS. 2, 3 and 4, push rod 50 is preferably a hollow tubular reservoir portion to promote weight savings for the dispensing handle. Disposed at the lower end of the push rod 50 are radial holes 51 which provide drainage outlets for liquid that would otherwise become trapped in the push rod 50 if the dispensing handle was in a substantially vertical position. Push rod 50 extends from immediately below the upper valve assembly 20 to immediately above the lower valve assembly 40. Notably, the push rod 50 does not abut directly against upper valve stem lip 33 in storage mode. Because of this, the reservoir and dispensing handle 10 may be oriented substantially horizontally without allowing any fluid to leak out from chamber 52 through upper valve body passageway 23.

As illustrated in the preferred embodiment of FIG. 4, the push rod 50 receives in its internal bore the lower valve stem 60. Lower valve stem 60 is attached to push rod 50 by pin 66. Alternatively, a screw, adhesive or the like may be used in place of pin 62 to attach push rod 50 to lower valve stem 60. Lower valve stem 60 extends from push rod 50 through internal bore 45 of lower valve body 42, and through passageway 43, to below lower valve body 42, where the lower valve stem 60 terminates at lower lip 63. In an alternative embodiment, the lower valve stem may be of reduced diameter, or include valleys, in the portion surrounded by passageway 43 to improve the flow of liquid through the passageway 43 between the lower valve body 42 and the lower valve stem 60.

In the preferred embodiment, bias element 68 encircles valve stem 60 and provides bias between push rod 50 and lower valve body 42. O-ring 65 is disposed on, or at least near lower lip 63. In storage mode (shown in solid lines) O-ring 65 seats tightly between lower lip 63 and the lower portion of the lower valve body 42 so that fluid cannot pass through passageway 43. Notably, any sealing mechanism may be used in place of the O-ring to create an air tight seal between the lower portion of lower valve body 42 and lip 63. In an alternative embodiment, the lower portion of the lower valve body 42 around the passageway 43 may be beveled to facilitate seating of the O-ring 65 against the valve body 42. In dispensing mode (shown in broken lines) lower valve stem 60 is displaced downward to break the seal between lower lip 63 and lower valve body 42.

As depicted in FIGS. 2 and 4, the lower valve body 42 is sealably displaced in tubular reservoir portion 11. O-ring 44 creates an air tight seal between lower valve body 42 and tubular reservoir portion 11. Any sealing mechanism may be used in place of O-rings 24 and 44 that creates an air tight seal between lower valve body 42 and tubular reservoir portion 11. Further, any number of O-rings in addition to those depicted may be used, depending on the application.

In the preferred embodiment, the lower portion of the lower valve body 42 abuts end connector 90. In an alternative embodiment, the lower portion of lower valve body 42 may include a valve seat (not shown) which couples directly to an internal annular bore (not shown) of end connector 90. In the preferred embodiment as depicted in FIGS. 2 and 4, end connector 90 is cylindrical and sealably fits inside tubular reservoir portion 11. The end connector 90 is fixed to the tubular reservoir portion by way of detents 12. Other means of attachment, such as fasteners or adhesives, are readily appreciated by those skilled in the art, O-ring 94 creates an air tight seal between tubular reservoir portion 11 and end connector 90. End connector 90 includes a first internal bore 95, in which lip 63 and lower valve stem 60 may longitudinally traverse, and a second internal bore 93.

At the lower most portion of the second internal bore 93, discharge outlet 98 extends radially outward. Discharge outlet is threaded so that it can receive outlet nozzle 100. In an alternative embodiment, discharge outlet 98 is not threaded and therefore cannot receive any outlet nozzle. In the preferred embodiment, because the discharge outlet is threaded, it can accept a variety of different sized and shaped nozzles to accommodate various flow rates of fluid, as well as fluids of different viscosities being dispensed.

End connector 90 is outfitted with yoke slot 102, and bolt hole 104. As depicted in FIGS. 1 and 4, yoke 82 is received in yoke slot 102, with bolt 104 positioned through the yoke to secure the mop head 80 to the dispensing handle 10. Other end connectors will be readily appreciated by those skilled in the art that would sufficiently connect mop head 80 to dispensing handle 10. Other cleaning implements such as a string mop, a squeegee, and a broom may be substituted for the flat mop head 80 as will be appreciated by those skilled in the art.

Figure 5:
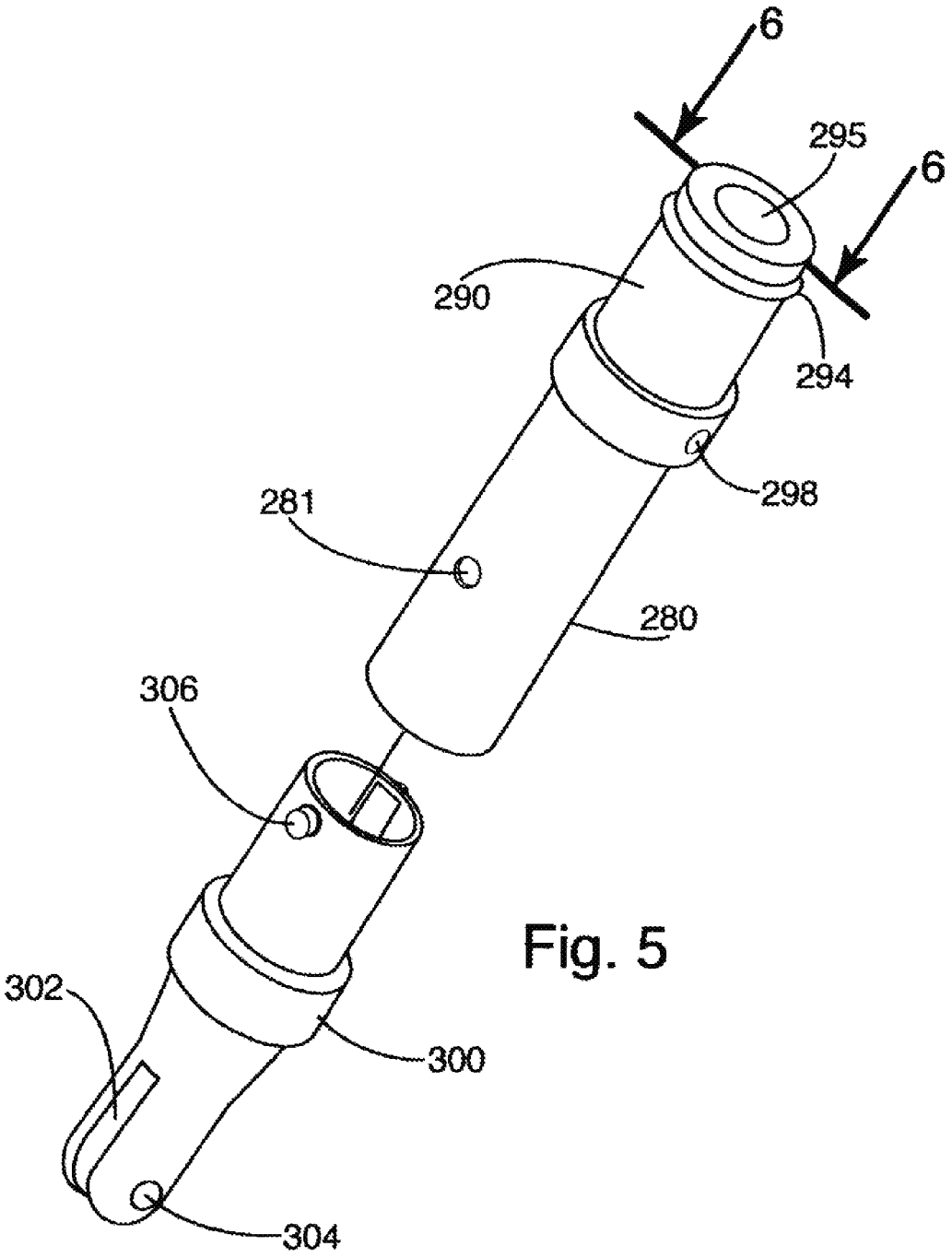
FIG. 5 is an alternative embodiment of the internal components and attachments of the apparatus.
Figure 6:
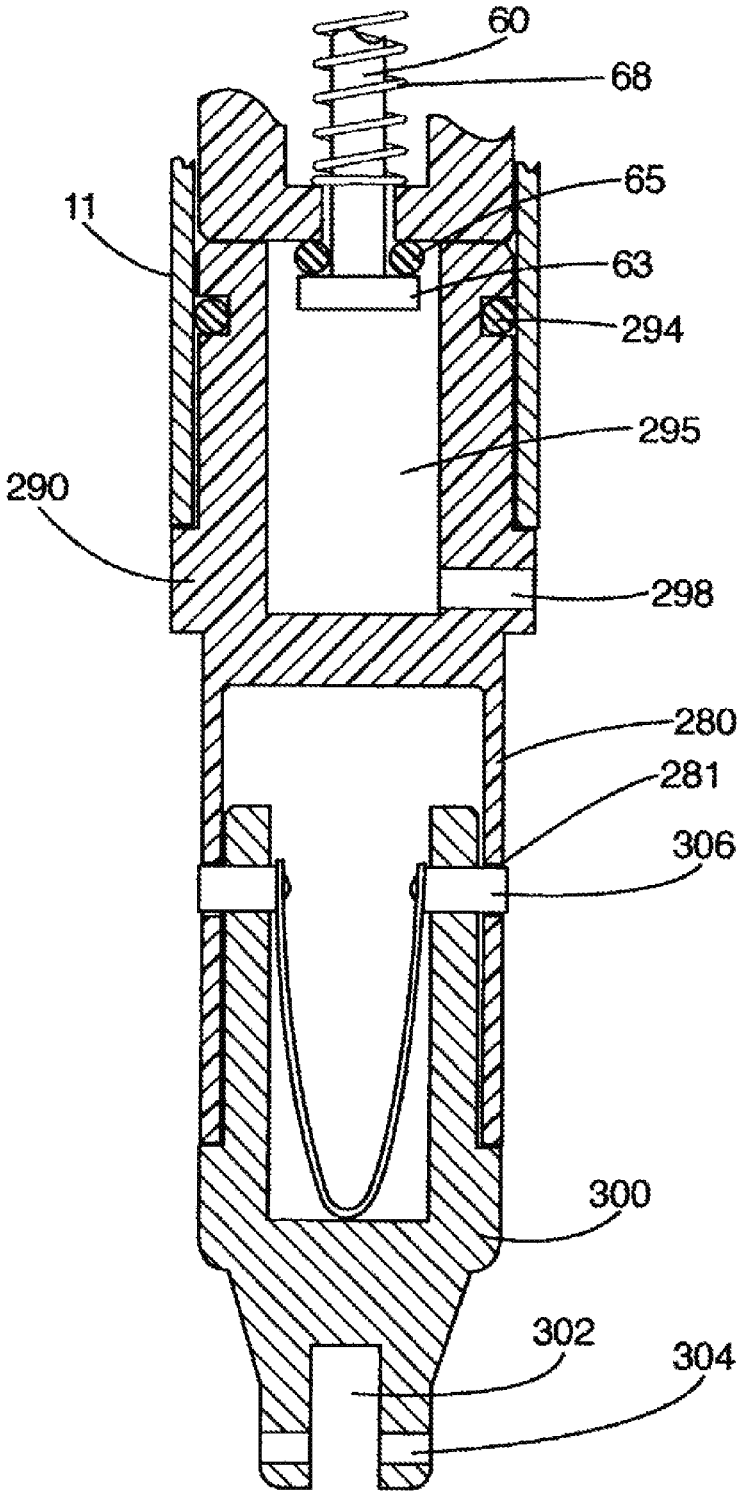
FIG. 6 is a sectional view of the apparatus taken along line 6-6 of FIG. 5.

In an alternative embodiment, as depicted in FIGS. 5 and 6, the end connector 290 is configured to attach to an autoclavable mounting connector 300. End connector 290 mounts and seals with O-ring 294 in tubular reservoir portion 11 in the manner described above in the preferred embodiment. Notably, the discharge outlet 298 of the alternative embodiment may be threaded to receive a variety of different nozzles as described above.

End connector 290 includes receiver shaft 280. Receiver shaft 280 defines holes 281. Holes 281 are positioned to receive tongs 306 and attach mounting connector 300 to the end connector 290. Many other means for releasably attaching receiver shaft 280 to mounting connector 300 will be readily appreciated by those in the art. Mounting connector includes slot 302 and bolt hole 304, which may be used in the same manner as described above in the preferred embodiment to attach various cleaning attachments thereto.

The main principle of operation of the preferred embodiment shown in FIGS. 2, 3 and 4 is that when air enters the chamber 52, though upper valve assembly 20 by depressing the button assembly 30, a corresponding amount of liquid held in chamber 52 is discharged through the lower valve assembly 40, out through discharge outlet 98, and onto a surface being cleaned. Liquid will tend to flow out of the chamber by gravity, but the liquid is not discharged from the chamber unless an equal amount of air replaces it.

The dispensing handle generally has two modes in which it may be used; storage mode, and dispensing mode. In storage mode, liquid is retained in tubular reservoir portion 11, sealed between valve assemblies 20 and 40 by way of associated O-rings 24 and 44.

As seen in FIGS. 3 and 4, in storage mode (shown in solid lines) spring 38 provides bias to force upper valve stem 34, lip 33, and associated O-ring 35 upward, to form a fluid tight seal between O-ring 35 and the lower portion of upper valve body 22. In this manner, no air can enter chamber 52 through internal passageway 23. Accordingly, no liquid may be displaced from chamber 52.

In storage mode, push rod 50 is displaced near upper valve stem 34, but not immediately abutting the valve stem 34. However, push rod 50 is contacted when the push button assembly is fully depressed in dispensing mode, as described below. Push rod 50 does not abut valve stem 34 so that should push button assembly 30 be accidentally partially depressed, push rod 50 will not activate lower valve assembly 40 to dispense fluid from the dispensing handle.

In storage mode (shown in solid lines) as depicted in FIGS. 3 and 4, the lower valve assembly prevents liquid from being emptied from chamber 52. Spring 68 provides an upward force against push rod 50, and consequently lower valve stem 60. Accordingly, O-ring 65 seals itself between the lower portion of lower valve body 42 and lip 63, effectively sealing off passageway 43 so that no liquid may flow there through and into internal bore 95. In storage mode with both upper and lower valve assemblies 20 and 40 acting in concert, liquid cannot escape internal chamber 52.

In dispensing mode, air is allowed to enter the internal chamber 52 through upper valve assembly 20, and a corresponding amount of liquid is dispensed through lower valve assembly 40.

As depicted in FIGS. 2, 3 and 4, to initiate the dispensing mode, push button 32 is manually depressed by an operator. During initial depression, spring 38 is compressed, the airtight seal created by O-ring 35 between the lower portion of upper valve body 22 and lip 33 is broken, allowing air to enter internal chamber 52 through internal passageway 23. As depicted in FIG. 3 in broken lines, after the push button 32 has been depressed halfway through its stroke, it engages push rod 50. Upon further depression, push rod 50 is also forced downward. When push rod 50 moves downward, it compresses spring 68, and simultaneously moves lower valve stem 60 downward. Consequently, the air tight seal created by O-ring 65 between the lower portion of lower valve body 42 and lip 63 is broken, allowing liquid to empty from internal chamber 52, through passageway 43, through first internal bore 95, through second internal bore 93, and out discharge outlet 98 into the environment. As discussed above, discharge nozzle 100 may be of varying configurations to provide different dispensing patterns or flow rates to allow fluids of different viscosities to be dispensed. To change the nozzle 100, nozzle 100 is simply unscrewed from the threads and replaced with another nozzle suitable for the given application.

Dispensing of fluid out from chamber 52 into the environment will continue until the chamber is empty while push button 32 is fully depressed by the operator. To cease dispensing and return the dispensing handle to storage mode the operator must discontinue depressing push button 32. When depression is discontinued, spring 68 moves lower valve stem 60 and lip 63 upward so that fluid tight seal is formed by the O-ring 65 pressed against the lower portion of the lower valve body 42. Accordingly, liquid can no longer escape from internal chamber 52 through now-sealed passageway 43.

Similarly, when the operator discontinues depression of push button 32 as depicted in FIG. 3 spring 38 moves upper valve stem 34 upward so that O-ring 35 forms an air tight seal between lip 33 and the lower portion of the upper valve body 22, effectively sealing off passageway 23 so that air can no longer enter internal chamber 52. The operator may dispense liquid in a variety of volumes depending on how long the push button 32 is fully depressed to allow liquid to escape by gravity from the internal chamber 52.

Notably, the above described structure of the dispensing handle 11 also facilitates filling and routine cleaning of the dispensing mechanisms. To fill the tubular reservoir portion 11, that is, internal chamber 52, the operator must grasp the upper valve assembly 20 by lip 25 and pull it out from tubular reservoir portion 11. Liquid may then be poured into the tubular reservoir portion 11. Beveled edge 12 facilitates such pouring. After the tubular reservoir portion is filled, the operator may replace the upper valve assembly 20 back in tubular reservoir portion 11.

Refill/Add-On Reservoir Receiver and Dispensing System 400

Figure 7A:
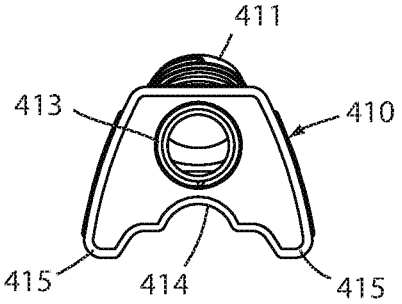
FIG. 7A is a bottom plan view of the refill/add-on reservoir container 410.
Figure 7:
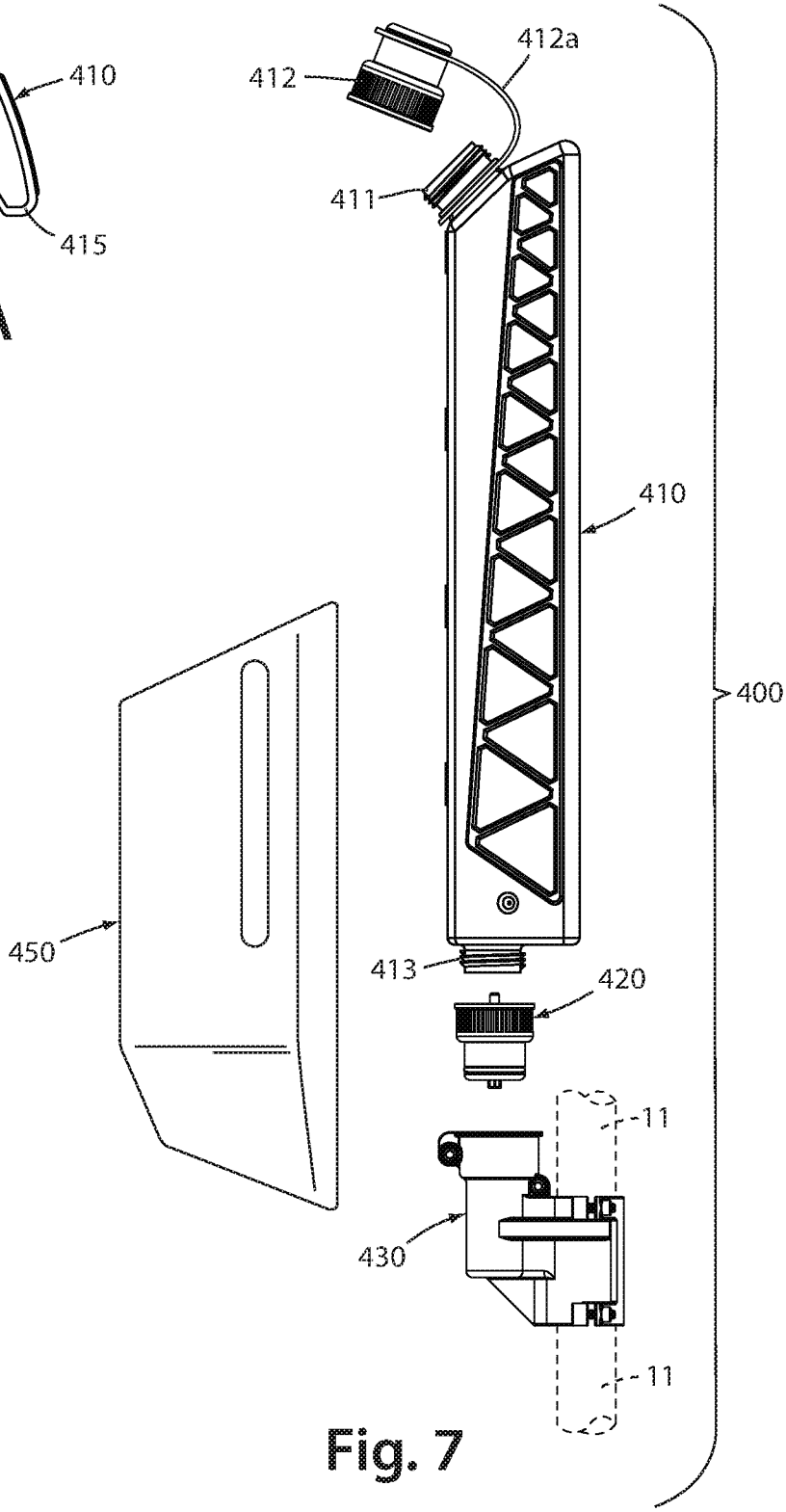
FIG. 7 is an exploded view of the refill/reservoir system 400, comprising the integral refill/add-on reservoir receiver 450, refill/add-on reservoir fluid container 410, and associated components of each.
Figure 8:
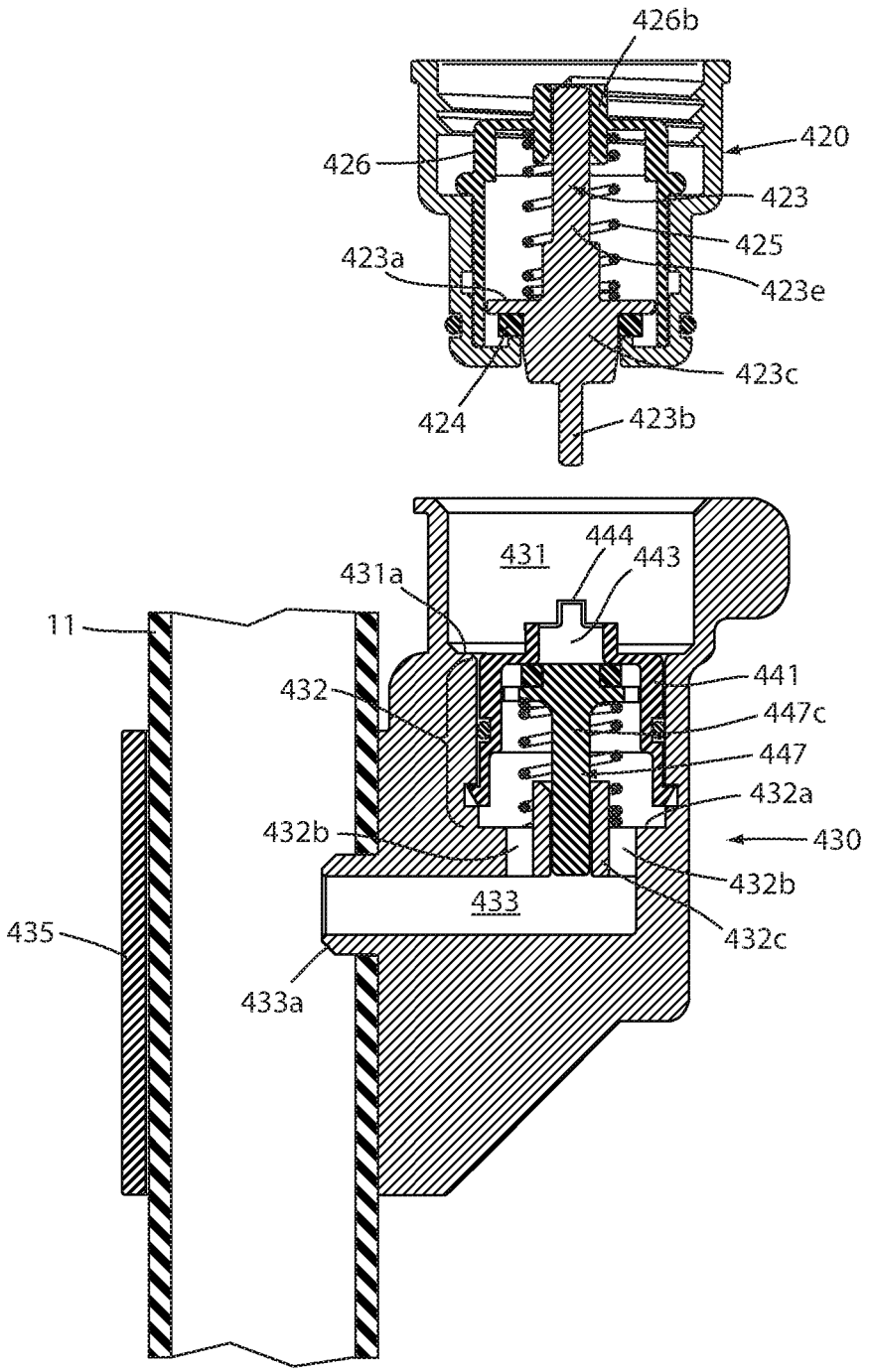
FIG. 8 is cross section showing the receiver dispensing valve 430 integrated with the implement reservoir portion 11 of handle 10, and the bottom container valve 420 for the refill/add-on reservoir container 410.
Figure 9:
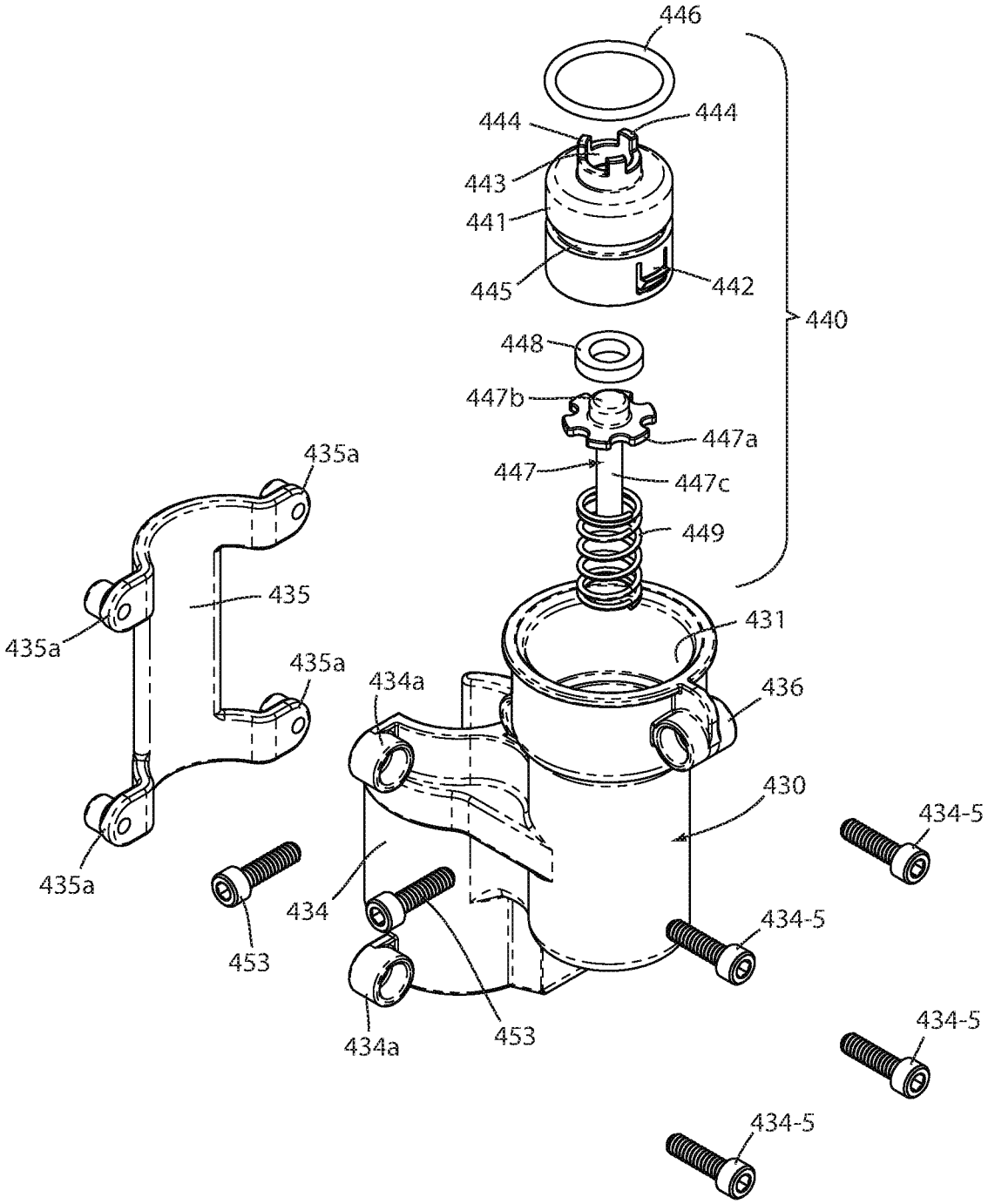
FIG. 9 is an exploded view of the receiver dispensing drain 430 and dispensing valve 440 assembly.
Figure 10:
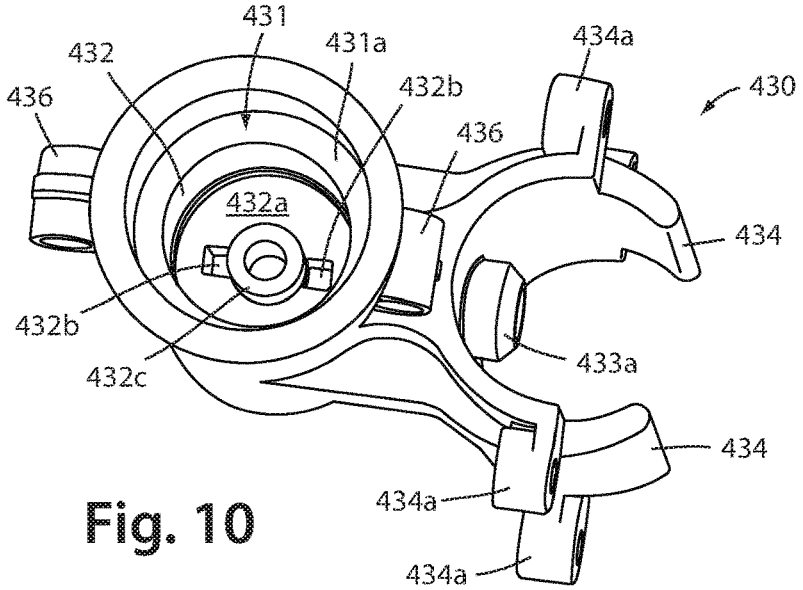
FIG. 10 is a top perspective view of the receiver dispensing drain 430.
Figure 11A:
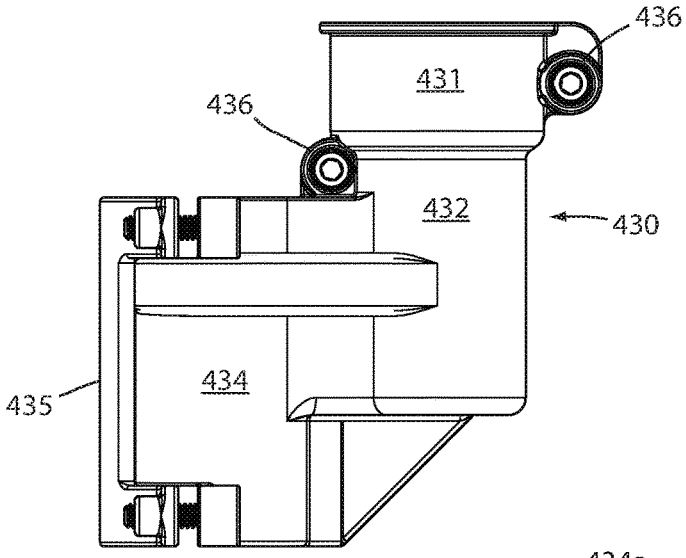
FIG. 11A is a side elevation of dispensing drain 430.
Figure 11B:
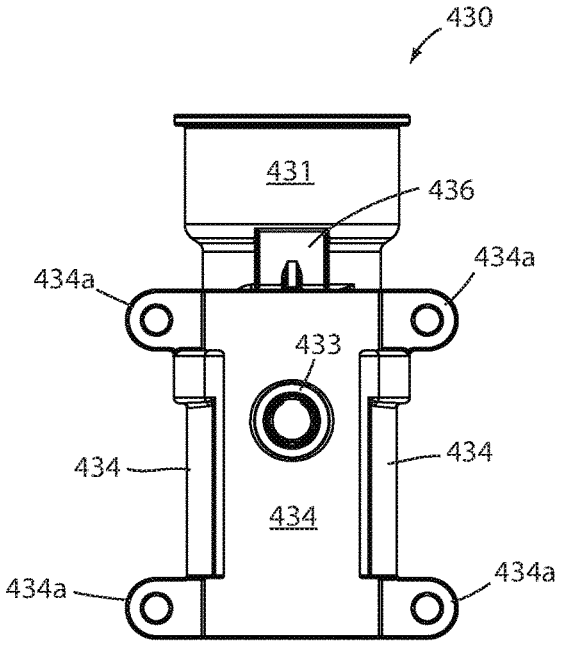
FIG. 11B is an inside end elevation of dispensing drain 430 with handle mounting strap 435 removed.
Figure 12:
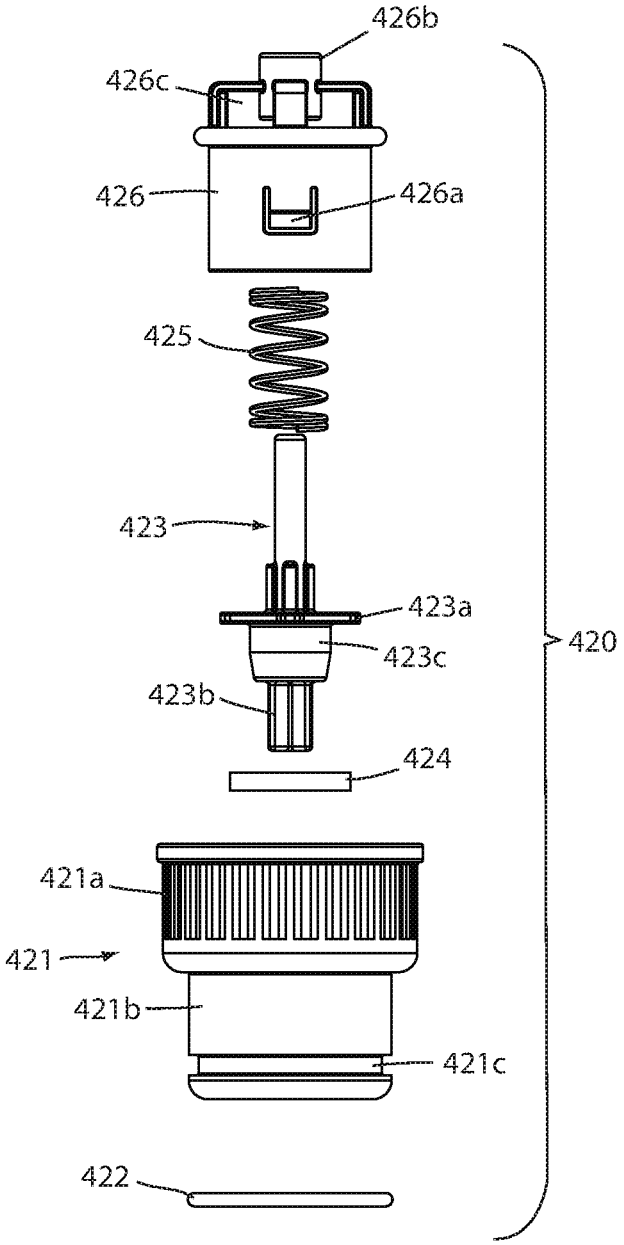
FIG. 12 is an exploded view of the bottom container valve 420 for the refill/add-on reservoir container 410.
Figure 12A:
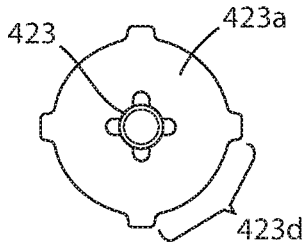
FIG. 12A is a top plan view of valve seal 423.
Figure 13:
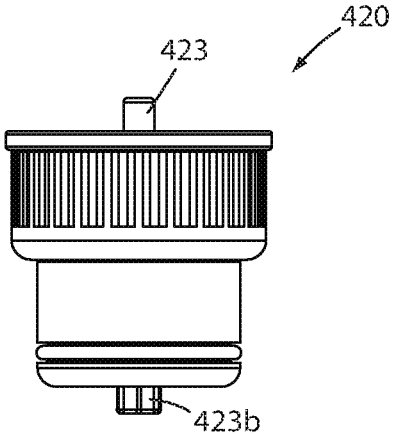
FIG. 13 is a side elevation of a portion of the bottom container valve 420.
Figure 14:
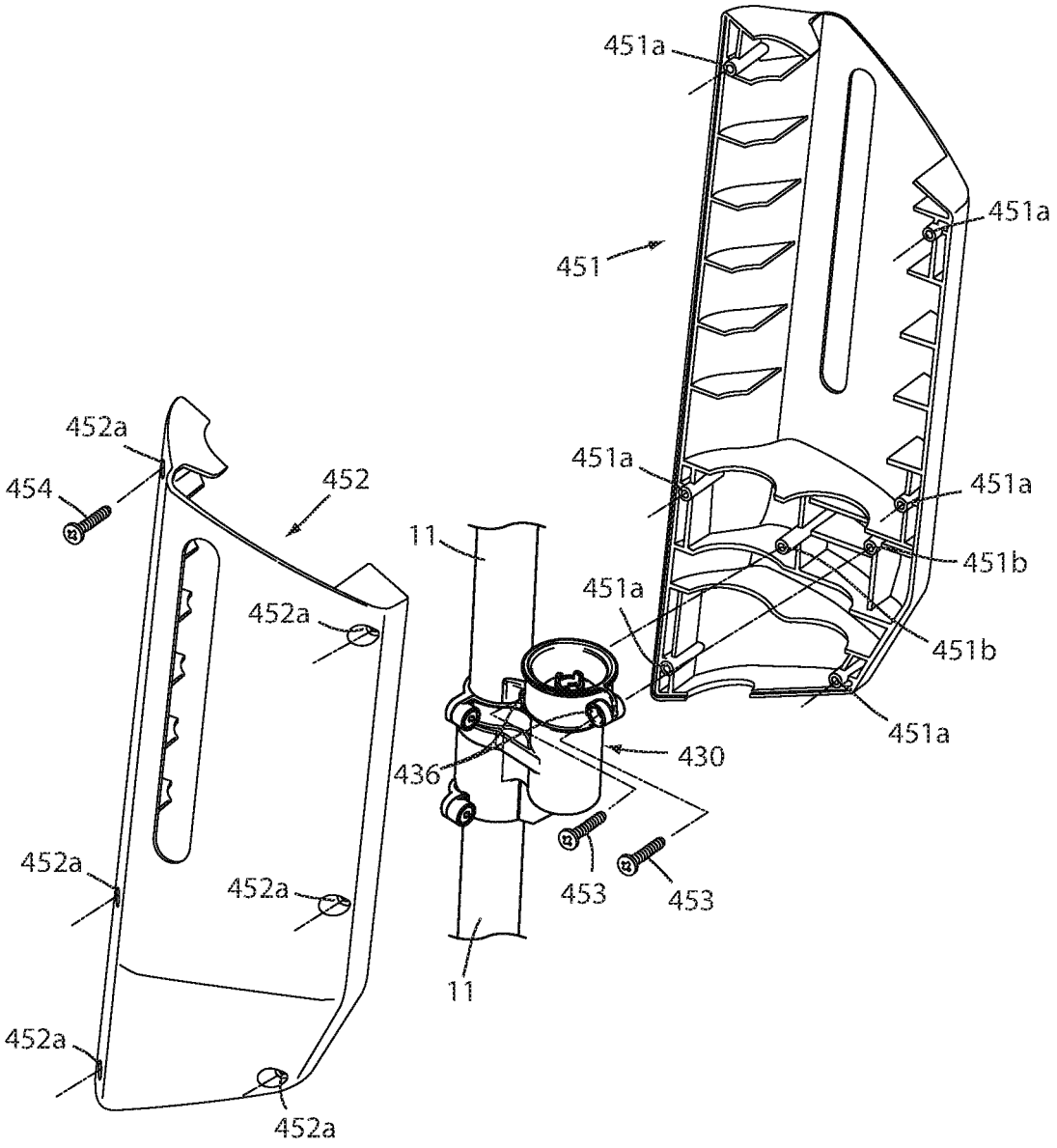
FIG. 14 is an exploded view of the components of the refill/add-on reservoir receiver 450.

In the preferred embodiment, refill/add-on reservoir receiver and dispensing system 400 includes refill/add-on reservoir container 410, and a receiver 450 therefore, which is integrally mounted on fluid reservoir portion 11 of handle 10 (FIGS. 1 and 7). Receiver 450 includes a receiver dispensing drain 430 which embraces and is secured to the tubular reservoir portion 11 of handle 10. Receiver side panel 451 is secured to drain 430, and opposite side panel 452 is secured to side panel 451, to create a holster into which refill container 410 can be removably inserted (FIG. 14). Drain 430 includes a receiver dispensing valve assembly 440, and refill container 410 includes bottom container valve 420 (FIG. 8). When a refill container 410 is inserted into receiver 450, bottom container valve 420 interacts with receiver dispensing valve 440 to open both valves, allowing liquid in container 410 to drain into the reservoir portion 11 of handle 10, as needed to replenish the liquid in reservoir portion 11.

Refill/add-on reservoir container 410 includes a threaded top opening 411, and a threaded cap 412 tethered to it by a strap 412. A threaded bottom opening 413 may conic with a second cap 412 (not shown) on bottom opening 413. However, in use, the cap 412 on bottom opening 413 is replaced with an internally threaded container valve 420. In this embodiment, container valve 420 is in the shape of an internally threaded cap, such that it can be threaded onto bottom opening 413 in place of a conventional cap 412. Alternatively, refill container 410 could be sold and/or reused with container valve 420 permanently or threadably attached to bottom opening 413. Container valve 420 controls the flow of fluid from container 410.

Refill container 410 also has a shape which is relatively thin from front to back such that it fits snugly around the reservoir tube 11 of handle 10. To that end, it includes a handle embracing recess 414 (FIG. 7A), and wings 415 which extend outwardly from recess 414 and further around to the sides of handle 10, but spaced therefrom.

Bottom container valve 420 includes a valve body 421 with an internally threaded cap portion 421*a*, and insert portion 421*b* and an O-ring groove 421*c* for receiving O-ring seal 422 (FIGS. 8, 12, 12A and 13). A valve seal assembly 423 is provided which is moveably secured within container valve 420 by a retainer cage 426. Cage 426 includes cylindrical body which fits within the insert portion 421*b* of container valve 420, and includes barbed tabs 426*a* which snap into apertures in the internal sides of insert portion 421*b* to secure cage 426 in place.

Cage 426 includes upper fluid flow openings 426*c* through which fluid can flow from container 410 when valve 420 is open. Cage 426 also includes a valve seal guide 426*b* at its top, into which the stem 423*e* of valve seal 423 is slideably inserted. Valve seal 423 includes a sealing plate 423*a* with openings 423*d* at or near the perimeter (FIG. 12A) which allows fluid to flow through when valve 420 is open. Sealing plate 423*a* is positioned atop and integral with a downwardly projecting sealing washer mounting barrel 423*c*. Sealing washer 424 fits around mounting barrel 423*c*, and has a smaller diameter than sealing plate 423*a*, such that the apertures 423*d* at or near the perimeter of sealing plate 423*a* are not blocked by sealing washer 424. Barrel 423*c* includes an inwardly tapered bottom portion, such that when valve seal 423 is pushed upwardly by pressure on pusher stem 423*b*, fluid will flow through openings 426*c* at the top of cage 426, down through plate 423*a* perimeter openings 423*d*, and down and around the inwardly tapered lower portion of sealing washer mounting barrel 423*c*. A spring 425 around the stem 423*e* of valve seal 423 biases sealing plate 423*a* and sealing washer 424 downwardly against the bottom of container valve 420, such that valve 420 is normally closed.

Receiver dispensing drain 430 (sometimes referred to as "drain 430") includes an upper receiver chamber 431 which terminates at an inwardly projecting ledge 431*a*, and opens into a valve passageway 432 (FIGS. 8-11). Valve passageway 432 terminates at a bottom floor 432*a*. Floor 432*a* includes a centrally located valve stem guide 432*c* which projects above and below floor 432*a*. Floor 432*a* also includes an opening 432*b* on each side of valve stem guide 432*c*, which allows fluid to flow through and out of valve passageway 432 and into lower drain passage 433 (FIGS. 8-11). Drain passage 433 terminates at a drain insert fitting 433*a* which projects from the side of drain 430, for insertion into an opening in the wall of reservoir tube portion 11 of handle 10. Drain 430 includes handle mounting arms 434 which embrace handle reservoir tube 11. Each of the two arms include two fasteners receiving ears 434*a* located at the top and bottom outside corners of arms 434. An arcuately shaped handle mounting strap 435 is shaped to fit partially around tube 11 opposite handle mounting arms 434. Strap 435 includes laterally projecting fastener receiving ears 435*a*, which match fastener receiving ears 434*a* on the handle mounting arms 434. Attachment fasteners 434-5, preferably screws, pass through openings in ears 434*a* and are threaded into receiving openings in ears 435*a* on strap 435, thus firmly holding receiver dispensing drain 430 in place on reservoir tube 11 of handle 10. Located on the outer side of drain 430 and inner side (toward reservoir tube 11) of drain 430 are attachment bosses 436 (FIGS. 10 and 11) for mounting sidewall 451 of receiver 450 (FIG. 14), as will be discussed further below.

Receiver valve assembly is seated and secured in valve passageway 432 of drain 430. A valve body 431 includes side spring tabs 432 which snap fit into recesses in the sidewalls of valve passageway 432 to hold valve body 431 in place. Valve inlet 443 at the top of valve body 441 allows fluid to flow into valve 441 when it is open. Stand-off tabs 444 around the top of inlet 443 keep the bottom of container valve seal barrel 423*c* from blocking valve inlet 443 when container valve 420 is inserted into receiver 431 of drain 430. Fluid can thus flow out of refill reservoir 410 through container valve 420, and around the sides of stand-off tabs 444 and into valve body 441. Valve body 441 includes on O-ring receiving groove 445, which accepts and O-ring seal 446.

The stem 447*c* of valve seal member 447 is slideably inserted into valve stem guide 432*c*. Valve seal 447 includes a top sealing plate 447*a* which includes openings 447*c* at or near the perimeter of sealing plate 447*a*. A top hat 447*b* projects upwardly from the center of sealing plate 447*a*, to provide a mount for sealing washer 448. Sealing washer 448 is seated over top hat 447*b*, and serves to seal valve inlet opening 443 when valve 440 is closed. A valve spring 449 wraps around the stem 447*c* of valve seal member 447 and extends between the bottom of sealing plate 447*b* and floor 432*a* of valve passageway 432. Thus, valve 440 is biased to its closed position.

Receiver 450 includes to side panels 451 and 452 (FIG. 14). Side panel 451 includes two fastener receivers 452. Fasteners (preferably screws) 453 are inserted through the openings in bosses 436 on the outside and inside of drain 430, and are threaded into fastener receivers 452. This secures side panel 451 to drain 430. Panel 451 also includes a plurality of additional fastener receivers 451*a* around its perimeter. Side panel 452 includes fastener openings 452*a* around its perimeter which correspond in assembled location to fastener receivers 451*a*. Fasteners 453 (preferably screws), are inserted through openings 452*a* and are threaded into receivers 451*a*, to secure the two receiver side panels 451 and 452 together, forming a holster for receiving a refill container 410.

Interaction of Container Valve 420 and Dispensing Drain Valve 440

Container valve 420 is biased to its closed position, such that refill/reservoir container 410 can be stored and carried with container valve 420 threaded onto bottom opening 413 without any fluid leaking out of container 410. Similarly, receiver dispensing valve 440 is biased closed, such that the reservoir portion 11 of handle 10 can be full of fluid, and can be used to mop, without fluid leaking back out through drain 430, so long as there is no container 410 positioned in receiver holster 450.

However, when a refill reservoir container 410 is inserted into receiver 450, container valve 420 and dispensing valve 440 interact to open both valves, and allow fluid to flow from refill/reservoir container 410 into reservoir handle 10 any time the level of fluid in the reservoir portion 11 has descended below the position of drain fitting 433*a* in reservoir portion 11 of handle 10. This interaction occurs when pusher 423*b* on container valve 420 engages the top of valve seal 447 of drain dispenser valve 440. The resulting interaction pushes valve seal 447 down and valve seal 423 up. Pushing valve seal 423 lifts sealing washer 424 up, and lifts barrel 423*c* sufficiently high that fluid flows past the tapered lower portion of barrel 423*c*, and down into the inlet 443 of drain valve 440. Pushing valve seal 447 down pushes sealing washer 448 down, opening inlet 443 in valve 440. Fluid thus flows down through the perimeter openings in sealing top plate 447*a*, down through valve passageway 442, through bottom openings 432*b*, into bottom drain passage 433, and out into reservoir tube 11 of reservoir handle 10. When the level of fluid in reservoir tube 11 is above the position of drain fitting 433*a*, fluid will not back flow out into refill reservoir container 410, so long as top opening cap 412 is tightly secured.

Refill/Add-On Reservoir Use

There are several ways to use the refill/add-on reservoir system 400 as integrated into cleaning implement 1 with its fluid reservoir handle 10.

1. Container 410 can be sold as a refill/add-on reservoir with or without container valve 420 attached. If sold without, bottom drain opening 413 would be capped with a conventional cap. To use the refill, container valve 420 would be substituted for the conventional cap, and container 410 with attached container valve 420 would then be inserted into receiver 450.

2. A used container 410 can simply be discarded and replaced with a new refill, or can itself be refilled. Preferably, the empty container 410 would be removed from receiver 450 prior to refilling. Top cap 412 would be unscrewed and removed, such that fluid can be poured into container 410 through top opening 411. Container valve 420 can be left in place during refilling, since it will be closed by being out of engagement with the dispensing drain valve 440 of receiver 450.

3. Whether containers 410 are used as new or refilled containers, it is contemplated that a user would have enough filled containers on a service cart as he or she made cleaning rounds, to replace empty containers 410 as they are used.

4. Container 410 can be used solely as an add-on reservoir, by independently filling or refilling handle reservoir 11 directly, and inserting container 410 into receiver 450 for replenishing fluid to handle reservoir 11 as it is depleted through use. Handle reservoir 11 of cleaning implement 1 can be filled directly with fluid, by removing from handle 10 the upper valve assembly 20. Liquid may then be poured into the tubular reservoir portion 11. After the tubular reservoir portion 11 is filled, the operator may replace the upper valve assembly 20 back in tubular reservoir portion 11. A full container 410 could be used to refill handle reservoir 11 by simply opening top cap 412 and pouring liquid from container 410 into the open top of reservoir 11.

5. Handle reservoir 11 can be filled with fluid with or without a refill/add-on reservoir container 410 inserted in receiver 450. Of course, an empty container 410 would be removed from receiver 450 prior to refilling handle reservoir tube 11 directly, but a full replacement container 410 could be inserted into receiver 450 either before or after direct refilling of handle reservoir 11. Either way, added fluid will not drain out of handle reservoir 11 through add-on reservoir drain 430 during the refilling process, since drain valve 440 will be closed if container 410 is not present during the refilling operation, and the top cap 412 will be tightly sealed if the full container 410 is present during the handle reservoir filling.

6. Containers 410 can also be used to refill an empty handle reservoir 11 by removing the empty container 410 from receiver 450 and inserting a full container 410 into receiver 450. For such refilling of handle reservoir 11, container cap 412 would be loosened to allow air to flow into container 410. Container 410 would then drain quickly through open valves 420 and 440 into the empty handle reservoir 11. If this process were conducted with implement handle 10 in a generally vertical position, as shown in FIG. 1, reservoir 11 would only be filled to the level of drain opening through fitting 433*a*. However, by laying handle 10 flat, with drain opening 433*a* located on the top side of the horizontal handle 10, the entire handle reservoir 11 could be refilled without removing upper valve assembly 20. It might take more than one refill container 410 to fully fill handle reservoir 11, depending on relative capacities of container 410 and reservoir 11. Either way, a fresh container 410 can be inserted into receiver 450 after the refilling of reservoir is complete and any container 410 has been depleted.

7. Most preferably however, handle reservoir 11 is never allowed to become totally empty during use in the cleaning process. Instead, the user simply removes and replaces containers 410 as they become empty. That will always occur before handle reservoir 11 becomes totally empty, since receiver 450 will be located on handle 10 at some convenient distance above the bottom of handle reservoir 11.

Regardless of which or which combination of the above variations on use of containers 410 are employed, the function of container 410 during the cleaning process remains the same. As the liquid is dispensed from handle 10, the fluid in handle reservoir 11 eventually drains to the point that fluid from container 410 begins to flow into reservoir portion 11. Top cap 412 remains tightly sealed during cleaning use, such that cleaning implement 1 can be used vigorously and set aside in various positions during use without worrying about liquid being siphoned back through or draining out of container 410 through an open or only loosely covered top opening 411 of container 410. As containers 410 are depleted, the depleted container 410 is removed from receiver 450 and a new or refilled container 410 is inserted into it. The refill/add-on reservoir system 400 of the present invention gives the user a greater amount of fluid to dispense than is the case with the reservoir handle implement alone. It also gives the user a convenient way to keep operating without having to worry about refilling a totally empty handle reservoir 11 during use.

The above description is that of a preferred embodiment of the invention. Various alterations and changes can be made without departing from the spirit and broader aspects of the invention as defined in the appended claims. Further, any reference to claim elements in the singular, for example, using the articles "a," "and," "the," or "said," is not to be construed as limiting the element to the singular. The claims are to be interpreted in accordance with the principles of patent law including the doctrine of equivalents.

What is claimed is:

1. A cleaning implement comprising: a cleaning head; a fluid reservoir handle connected to said cleaning head; said fluid reservoir handle including a handle reservoir for storing liquid, and a dispensing valve for dispensing fluid from said handle reservoir to or adjacent to said cleaning head; said handle including a receiver integrally connected to said handle in flow communication with said handle reservoir; said receiver being adapted to removably receive a refill/add-on reservoir container filled with fluid, whereby fluid flows from said container into said handle reservoir to supplement and/or replenish the volume of liquid contained said handle reservoir; said receiver forming no part of said handle reservoir whereby said handle reservoir can hold fluid independently of said receiver or any refill/add-on reservoir container placed in said receiver, and any refill/add-on reservoir container serves as a fluid reservoir independently of said handle reservoir.

2. The cleaning implement of claim 1 in which said receiver includes: a fluid passageway into said handle reservoir, and a normally closed receiver valve in said fluid passageway, which prevents the flow of liquid into said handle reservoir unless opened; a refill/add-on reservoir container having a bottom opening and a normally closed container valve connected to said opening, which prevents the flow of fluid from said container unless said container valve is opened; said container valve and said receiver valve being adapted to interact and open each other when said container is inserted into said receiver, thus opening both said valves to the flow of liquid therethrough.

3. The cleaning implement of claim 2 comprising: said receiver valve including a seal moveable between an open and a closed position for opening and closing said receiver valve; and said container valve including a seal moveable between an open and a closed position for opening or closing said container valve; said receiver valve seal and said container valve seal each being biased into their closing positions; said receiver valve seal and said container valve seal contacting one another and moving each other to their respective open positions when said container is inserted into said receiver, such that said receiver valve and said container valve remain open when said container is inserted into said receiver.

4. The cleaning implement of claim 3 in high said container valve includes a bottom opening, and said container valve seal is biased downwardly to its position closing said bottom opening; said valve seal including a portion extending through said bottom opening, and including a downwardly projecting pusher for engaging said receiver valve seal; said receiver valve including a top opening, said receiver valve seal being biased upwardly into engagement with said top opening; said pusher on said container valve seal being dimensioned to engage said receiver seal when said refill/add on reservoir container is inserted into said receiver, pushing said receiver valve seal downwardly and said container valve seal upwardly, thereby opening both said container valve and said receiver valve to fluid flow.

5. The cleaning implement of claim 2 in which said receiver and said reservoir handle are in flow communication through a first opening in said reservoir handle; said reservoir handle including a second separate fill opening for filling said reservoir handle with liquid independently of fluid flowing in from a refill/reservoir container located in said receiver.

6. The cleaning implement of claim 2 in which said reservoir handle includes a reservoir tube; said refill/add-on reservoir container having a shape which is relatively thin from front to back such that it fits snugly around said reservoir tube; said refill/add-on reservoir container including a reservoir tube embracing recess and wings which extend outwardly from recess and further around to the sides of said reservoir tube.

7. The cleaning implement of claim 6 in which said refill/add-on reservoir container includes a top opening and a top cap, and a bottom opening to which said container valve is connected.

8. The cleaning implement of claim 7 in which said container valve is in the shape of a cap for fitting onto said bottom opening of said container.

9. The cleaning implement of claim 2 in which said receiver comprises a receiver dispensing drain which embraces and is secured to said reservoir handle in flow communication therewith; and side panels secured to said receiver dispensing drain to create a holster for receiving said refill/add on container.

10. The cleaning implement of claim 9 in which said container includes a bottom opening to which a closure cap can be releasably secured; said container valve including a cap portion which can be secured to said bottom opening in said container.

11. A cleaning implement comprising: a cleaning head; a fluid reservoir handle connected to said cleaning head; said fluid reservoir handle including a handle reservoir tube for storing liquid, and a dispensing valve for dispensing fluid from said handle reservoir to or adjacent to said cleaning head; a refill/add-on reservoir receiver and dispensing system which includes refill/add-on reservoir container, and a receiver therefore, said receiver being integrally mounted on said handle reservoir portion; said receiver including a receiver dispensing drain which embraces and is secured to said handle reservoir tube, and receiver side panels secured to said dispensing drain to create a holster into which said refill container can be removably inserted; said dispensing drain including a receiver dispensing valve assembly, and said refill container including a bottom container valve; said container valve and said receiver dispensing valve interacting to open both said valves when said refill container is inserted into said receiver, allowing liquid in container to drain into said handle as needed to replenish the liquid in said handle reservoir; said receiver forming no part of said handle reservoir whereby said handle reservoir can hold fluid independently of said receiver or said refill/add-on reservoir container placed in said receiver, and said refill/add-on reservoir container serves as a fluid reservoir independently of said handle reservoir.

12. The cleaning implement of claim 11 comprising: said container valve including a valve body with an internally threaded cap portion and insert portion depending therefrom; a retainer cage secured in said insert portion; a valve seal assembly moveably secured within said retainer cage; said cage including upper fluid flow openings through which fluid can flow from said container when said container valve is open; said valve seal being biased into a closing position wherein said fluid flow openings; said refill/add-on reservoir container including a threaded bottom opening to which either a threaded closure cap can be secured, or the threaded cap portion of said container valve can be secured.

13. The cleaning implement of claim 12 comprising: said receiver valve including a seal moveable between an open and a closed position for opening and closing said receiver valve; and said container valve including a seal moveable between an open and a closed position for opening or closing said container valve; said receiver valve seal and said container valve seal each being biased into their closing positions; said receiver valve seal and said container valve seal contacting one another and moving each other to their respective open positions when said container is inserted into said receiver, such that said receiver valve and said container valve remain open when said container is inserted into said receiver.

14. The cleaning implement of claim 13 in which said container valve includes a bottom opening, and said container valve seal is biased downwardly to its position closing said bottom opening; said valve seal including a portion extending through said bottom opening, and including a downwardly projecting pusher for engaging said receiver valve seal; said receiver valve including a top opening, said receiver valve seal being biased upwardly into engagement with said top opening; said pusher on said container valve seal being dimensioned to engage said receiver seal when said refill/add on reservoir container is inserted into said receiver, pushing said receiver valve seal downwardly and said container valve seal upwardly, thereby opening both said container valve and said receiver valve to fluid flow.

15. The cleaning implement of claim 14 comprising: said receiver dispensing drain including for receiving said container valve when said container is inserted into said receiver; a valve passageway in which said receiver valve is located; and a lower drain passage which terminates at a drain insert fitting which projects from the side of said drain and is inserted into an opening in the wall of said reservoir tube of said handle.

16. The cleaning implement of claim 11 comprising: said dispensing drain including handle mounting arms which embrace said handle reservoir tube; said receiver side panels being secured to said dispensing drain to also embrace and enclose said handle reservoir tube; said refill/add-on reservoir container having a shape which is relatively thin from front to back such that it fits snugly around said reservoir tube; said refill/add-on reservoir container including a reservoir tube embracing recess and wings which extend outwardly from recess and further around to the sides of said reservoir tube.

17. A cleaning implement comprising: a cleaning head; a fluid reservoir handle connected to said cleaning head; said fluid reservoir handle including a handle reservoir for storing liquid, and a dispensing valve for dispensing fluid from said handle reservoir to or adjacent to said cleaning head; said handle including a receiver integrally connected to said handle in flow communication with said handle reservoir; said receiver being adapted to removably receive a refill/add-on reservoir container filled with fluid, whereby fluid flows from said container into said handle reservoir to supplement and/or replenish the volume of liquid contained said handle reservoir; said receiver including: a fluid passageway into said handle reservoir, and a normally closed receiver valve in said fluid passageway, which prevents the flow of liquid into said handle reservoir unless opened; a refill/add-on reservoir container having a bottom opening and a normally closed container valve connected to said opening, which prevents the flow of fluid from said container unless said container valve is opened; said container valve and said receiver valve being adapted to interact and open each other when said container is inserted into said receiver, thus opening both said valves to the flow of liquid therethrough; said receiver valve including a seal moveable between an open and a closed position for opening and closing said receiver valve; and said container valve including a seal moveable between an open and a closed position for opening or closing said container valve; said receiver valve seal and said container valve seal each being biased into their closing positions; said receiver valve seal and said container valve seal contacting one another and moving each other to their respective open positions when said container is inserted into said receiver, such that said receiver valve and said container valve remain open when said container is inserted into said receiver; said container valve including a bottom opening, and said container valve seal is biased downwardly to its position closing said bottom opening; said valve seal including a portion extending through said bottom opening, and including a downwardly projecting pusher for engaging said receiver valve seal; said receiver valve including a top opening, said receiver valve seal being biased upwardly into engagement with said top opening; said pusher on said container valve seal being dimensioned to engage said receiver seal when said refill/add on reservoir container is inserted into said receiver, pushing said receiver valve seal downwardly and said container valve seal upwardly, thereby opening both said container valve and said receiver valve to fluid flow.

18. A cleaning implement comprising: a cleaning head; a fluid reservoir handle connected to said cleaning head; said fluid reservoir handle including a handy reservoir for storing liquid, and a dispensing valve for dispensing fluid from said handle reservoir to or adjacent to said cleaning head; said handle including a receiver integrally connected to said handle in flow communication with said handle reservoir; said receiver being adapted to removably receive a refill/add-on reservoir container filled with fluid, whereby fluid flows from said container into said handle reservoir to supplement and/or replenish the volume of liquid contained said handle reservoir; said receiver and said reservoir handle being in flow communication through a first opening in said reservoir handle; said reservoir handle including a second separate fill opening for filling said reservoir handle with liquid independently of fluid flowing in from a refill/reservoir container located in said receiver.

* * * * *